US010595575B2

(12) United States Patent
Baker

(10) Patent No.: US 10,595,575 B2
(45) Date of Patent: Mar. 24, 2020

(54) BONDING GARMENT

(71) Applicant: Nicholas M. Baker, North Hollywood, CA (US)

(72) Inventor: Nicholas M. Baker, North Hollywood, CA (US)

( * ) Notice: Subject to any disclaimer, the term of this patent is extended or adjusted under 35 U.S.C. 154(b) by 103 days.

(21) Appl. No.: 15/699,996

(22) Filed: Sep. 8, 2017

(65) Prior Publication Data

US 2018/0064187 A1 Mar. 8, 2018

Related U.S. Application Data

(60) Provisional application No. 62/384,945, filed on Sep. 8, 2016.

(51) Int. Cl.

| | |
|---|---|
| ***A41D 27/00*** | (2006.01) |
| ***A41B 1/08*** | (2006.01) |
| ***A41D 10/00*** | (2006.01) |
| ***A41D 13/12*** | (2006.01) |
| ***A41D 1/215*** | (2018.01) |

(52) U.S. Cl.

CPC ..... *A41D 27/00* (2013.01); *A41B 1/08* (2013.01); *A41D 1/215* (2018.01); *A41D 10/00* (2013.01); *A41D 13/1236* (2013.01); *A41B 2300/32* (2013.01); *A41B 2300/324* (2013.01); *A41B 2300/326* (2013.01); *A41D 2300/32* (2013.01); *A41D 2300/324* (2013.01); *A41D 2300/326* (2013.01)

(58) Field of Classification Search

CPC .... A41D 27/00; A41D 13/1236; A41D 1/215; A41D 10/00; A41B 1/08

USPC ..... 2/114, 115, 69, 104, 77, 73, 113

See application file for complete search history.

(56) References Cited

U.S. PATENT DOCUMENTS

| | | | | | |
|---|---|---|---|---|---|
| 4,144,593 | A * | 3/1979 | Timmons | A41D 1/215 | 2/104 |
| 5,093,932 | A * | 3/1992 | Doyle | A41D 13/1263 | 2/114 |
| 5,097,536 | A * | 3/1992 | Cohen | A41D 13/1245 | 2/106 |
| 5,133,086 | A * | 7/1992 | Truitt | A41D 13/1236 | 2/105 |
| 5,553,323 | A * | 9/1996 | Chou | A41D 13/1245 | 2/105 |
| 5,564,126 | A * | 10/1996 | Chou | A41D 13/1245 | 2/106 |
| 5,611,087 | A * | 3/1997 | Adkins | A41D 13/1236 | 2/114 |
| 7,181,773 | B1 * | 2/2007 | Piraka | A41D 13/1281 | 2/114 |
| 2006/0031976 | A1 * | 2/2006 | Nwawka | A41D 13/1245 | 2/114 |

(Continued)

*Primary Examiner* — Gloria M Hale

(74) *Attorney, Agent, or Firm* — Caesar Rivise, PC

(57) ABSTRACT

A garment for skin-to-skin bonding with an infant, comprising a back, a lower front, an upper front, a hem, sleeve holes and a collar, a receiving flap and a plurality of fasteners. The garment further comprises a receiving portion comprising an angled, substantially longitudinal break in the upper front. The receiving flap is operable to be removably joined by operation of the fasteners to a portion of the upper front to cover the receiving portion and to cause the upper front to take the visual appearance of a known article of clothing.

12 Claims, 4 Drawing Sheets

(56) References Cited

U.S. PATENT DOCUMENTS

| | | | | |
|---|---|---|---|---|
| 2007/0130668 | A1* | 6/2007 | Berman | A41D 13/1236 2/114 |
| 2007/0245450 | A1* | 10/2007 | Feodoroff | A41D 13/1245 2/114 |
| 2008/0115255 | A1* | 5/2008 | Gorman | A41D 13/1263 2/114 |
| 2009/0100569 | A1* | 4/2009 | Butler | A41D 13/1236 2/114 |
| 2010/0299803 | A1* | 12/2010 | Ladra | A41D 13/1245 2/83 |
| 2011/0107496 | A1* | 5/2011 | Harris | A41D 13/1245 2/114 |
| 2018/0064187 | A1* | 3/2018 | Baker | A41D 1/215 |

* cited by examiner

BONDING GARMENT

RELATED U.S. APPLICATION

The present application is related to and incorporates by reference earlier filed U.S. provisional patent application No. 62/384,945.

FIELD OF THE INVENTION

The present invention relates generally to garments and more particularly to garments permitting a wearer to bond with an infant through skin-to-skin contact.

BACKGROUND

A need remains for an improved bonding garment, which resembles a known garment and permits the wearer an easy means to expose skin for skin-to-skin contact, also known as kangaroo care, with an infant child and to enclose the child in the opening for comfort, warmth and to re-establish the appearance of the garment while bonding.

Numerous garments have been proposed for use by nursing mothers to permit access to the mother's breast. For example, U.S. Pat. No. 7,810,171 to Moore. Such garments do not provide an opening having sufficient access to the wearer's chest to facilitate the placement of a child in skin-to-skin contact with the wearer. Additionally, such garments are of no use to male caregivers.

Prior garments that increase the area of access fail to maintain the appearance of known garments and fail to maintain the privacy of the wearer, while permitting the operability of the garment. For example, the garment of U.S. Pat. No. 9,402,430 to Jensen comprises separate lateral front portions, requiring the user to fully expose their chest in order to provide access to their chest for skin-to-skin child contact. Jensen further requires the inclusion of an internal pocket, which, in combination with the remaining structure of the garment, prevents the garment from appearing as a typical article of fashion when not in use for kangaroo child care. Similarly, U.S. Pat. No. 5,946,725 to Shatzkin fails to provide means for maintaining the upright positioning of the claimed shirt or blouse's upper front for permitting the public use of the garment without revealing the wearer's chest to others.

A clear need therefore remains for a bonding garment, which resembles a known garment and permits the wearer an easy means to expose skin for skin-to-skin contact with an infant child and to enclose the child in the opening for comfort, warmth and to re-establish the appearance of the garment while bonding, while also maintaining the privacy of the wearer.

BRIEF SUMMARY OF THE INVENTION

The present invention is a bonding garment to be worn by an individual to permit easy exposure of the wearer's skin, without removal of the garment to, in turn, permit skin-to-skin contact with a child placed into the opening portion of the garment, which opening portion provides said exposure to the wearer's skin but substantially maintains the privacy of the wearer. The construction of the present bonding garment further causes the garment to appear as a standard article of clothing, permitting the wearer to wear the garment in normal daily dress.

DETAILED DESCRIPTION OF THE INVENTION

The invention of the present disclosure is described below with reference to certain embodiments. While these embodiments are set forth in order to provide a thorough and enabling description of the invention, these embodiments are not set forth with the intent to limit the scope of the disclosure. A person of skill in the art will understand that the invention may be practiced in numerous embodiments, of which those detailed here are merely examples. In order to allow for clarity of the disclosure of the claimed invention, structures and functions well known to those skilled in the art are not here disclosed. Those skilled in the art should also realize that equivalent bonding garments do not depart from the spirit and scope of the invention in its broadest form.

The present invention is a bonding garment to be worn by an individual and permit easy exposure of the wearer's skin, without removal of the garment to, in turn, permit skin-to-skin contact with a child placed into the opening portion of the garment, which opening portion provides said exposure to the wearer's skin. The garment is designed to provide easy access to the chest of the user to permit kangaroo care of a child while maintaining privacy of the wearer and retaining the visual appearance of everyday clothing normally worn by men or women.

Figure 1A:
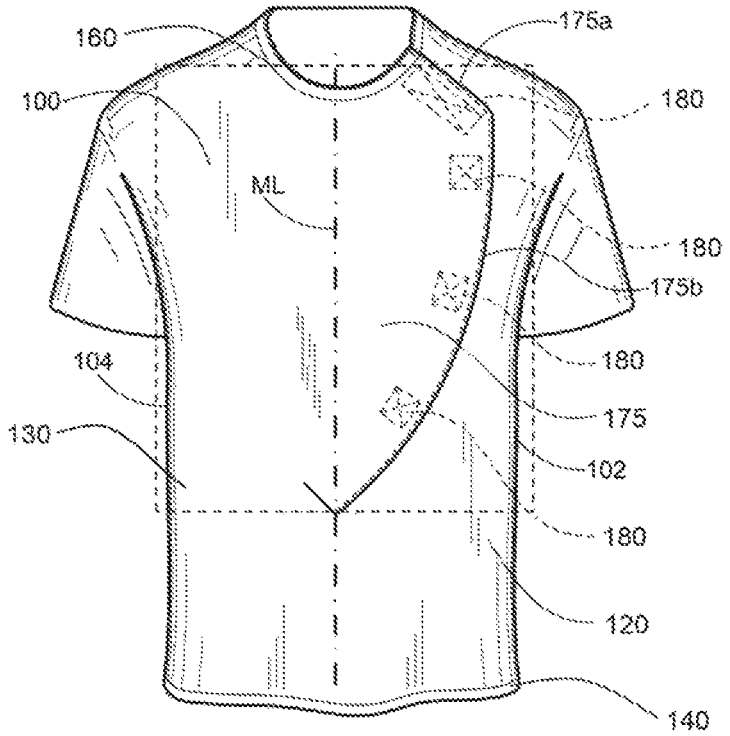
FIGS. 1*a* and 1*b* are front views of an embodiment of the present invention in the form of a t-shirt.
Figure 1B:
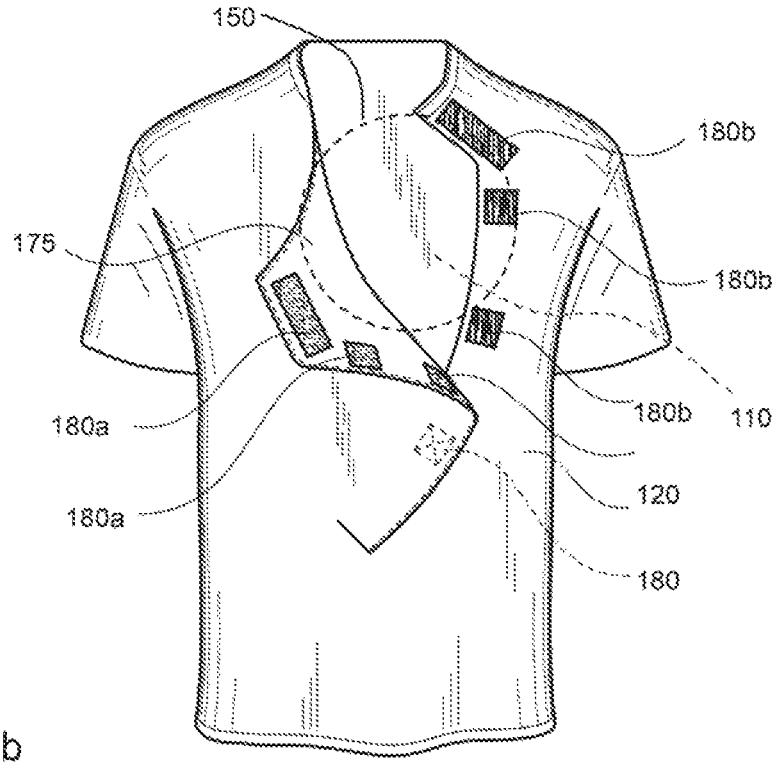
Figure 1C:
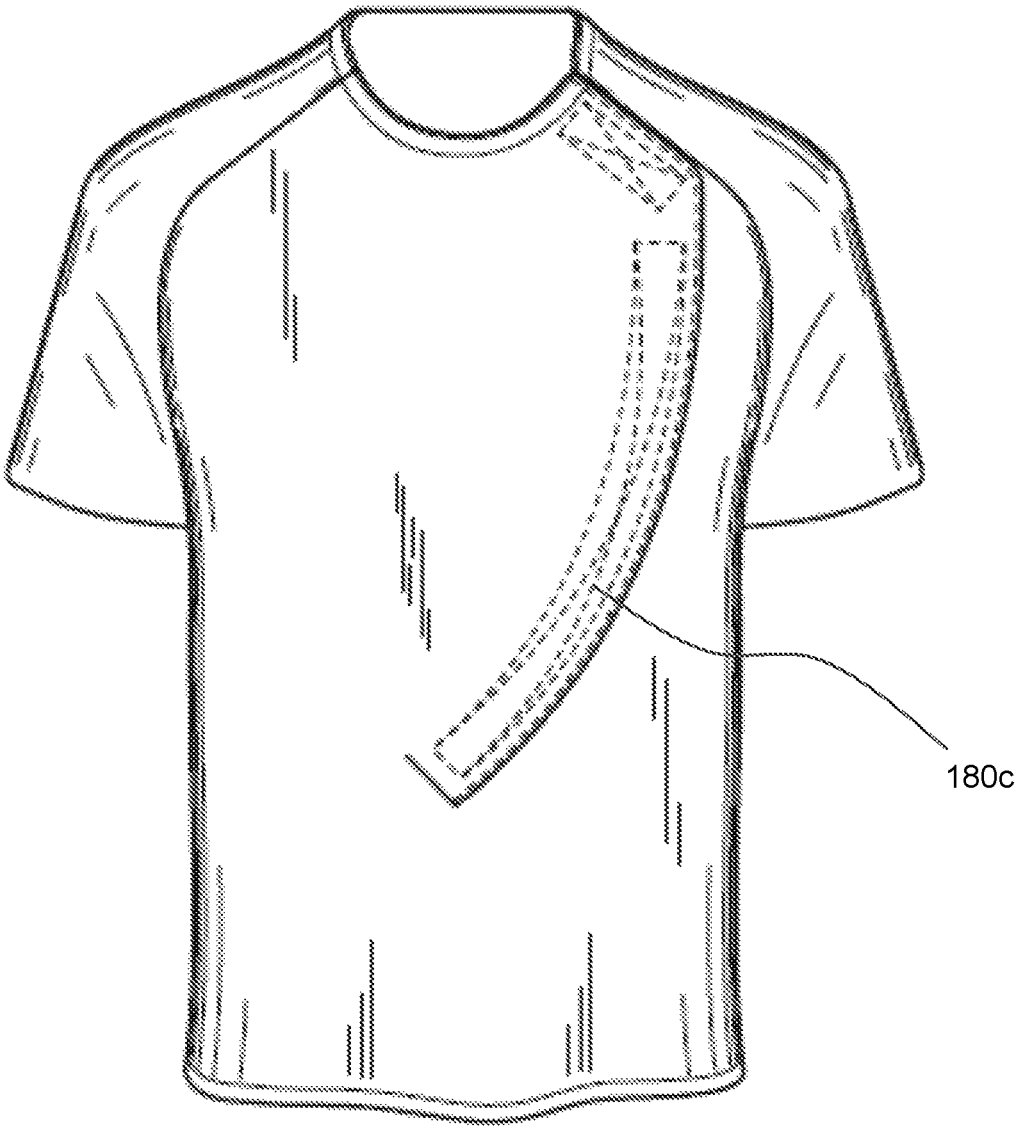
FIG. 1*c* is a front view of a garment of the present invention in the form of a raglan sleeve t-shirt.

Turning now to FIG. 1*a-c*, wherein like numbers represent like elements, a garment of the present invention is shown in the form of a t-shirt. The garment is comprised of a front panel 100, and a back panel 110, each of which extends between respective sides 102 and 104, with the midline of the front and back panels being designated by the reference "ML". The front panel 100 includes a lower front 120, and an upper front 130. As shown in the present figures, the upper front 130 and lower front 120 may be formed from a single piece of cloth, but those of skill in the art will understand that other, multi-component constructions are possible. Well known methods of garment construction may be employed to cause the front panel 100 and the back panel 110, lower front 120, and upper front 130 to be formed into the body of a t-shirt. For example, a side seam may be employed to connect the back panel 110 to the front panel 100 along the sides 102 and 104 portions. The upper front 130 further comprises a receiving portion 150, which is an opening formed by a substantially longitudinal break in the fabric of the upper front 130 and collar 160, permitting access to the front of the wearer's torso. A single receiving flap 175, similarly formed in the front panel 100 by the longitudinal break in the upper front and collar, is operable to releasably cover the opening of the receiving portion 150 and to be secured to the opposite side of the broken upper front by the use of a plurality of fasteners 180. The receiving flap 175 includes an upper edge portion 175*a* and a lower edge portion 175*b*. The upper edge portion 175*a* is linear and extends downward and outward at an angle from the midline ML. The lower edge portion 175*b* merges with the upper edge portion at a merger point. The lower edge portion 175*b* is somewhat arcuate and extends downward and inward at an angle from the outer end of the upper edge portion 175*a* at the merger point. The lower edge portion terminates closely adjacent the midline ML where the lower front 120 merges with the upper front 130. The receiving flap 175 is foldable out of the plane of the front panel along the midline ML from the closed state or position like shown in FIG. 1*a* to an open state or position. As can be seen in FIG. 1*a*, when the receiving flap 175 is in the closed state or position the lower edge portion 175*b* of the receiving flap located slightly below where the edge portions 175*a* and 175*b* merge together is located very close to the side 102. FIG. 1*b* shows the receiving flap in a partially open position, whereupon the flap is folded around the centerline ML so that the portion of the flap which is located contiguous to where the edge portions 175*a* and 175*b* merge together is located away from the side 102 and closer to the side 104. As should be readily appreciated by those skilled in the art, the receiving flap 175 can be folded completely about the centerline ML so that it is opened to a fully opened state (not shown) wherein the portion of the flap immediately adjacent where its edge portions 175*a* and 175*b* merge together is located very close to the side 104.

As shown in FIG. 1*b*, the fasteners 180 are placed to permit the closure of the receiving flap 175 by coupling a first flap side component of the fastener 180*a* to a second body upper side component of the fastener 180*b*. As further shown in FIG. 1*c*, a fastener 180*c* may be elongated to reduce the total number of fasteners. For ease of closure, the loop material may even be applied in a single strip, running the length of the receiving opening, or be applied in multiple strips adjoined or abutting to essentially form a single strip. Numerous known fasteners are suitable for use in accordance with the present invention, including but not limited to buttons, hook and eye closures, snaps, and hook and loop fastener. The selection of fastener type may be made fasteners based upon the convenience of operation by a wearer of the garment who is holding an infant child. When a hook and loop material closure is employed, the loop side of the hook and loop fastener material is preferably placed on the stationary garment portion, as shown in FIG. 2, to reduce the risk of injury to the child, such as by scratching, when the child is placed inside of or removed from the receiving portion 150. By contrast, the hook side of the hook and loop fastener material is affixed to the receiving flap portion 175. I may be desirable that the hook side fastener comprises multiple smaller segments, where the presence of less hook material surface area further reduces the likelihood of scratches to the child. Various embodiments, such as those employing buttons, may include a placket for finishing of the area holding the fasteners. As stated, other known fastening means may be employed, such as buttons, snaps and the like, or other means not presently known.

The garment of the present embodiment terminates at its bottom in a hem 140. Common methods of hem construction, well known in the art, are suitable for use here.

As shown in FIG. 1, receiving portion 150 and receiving flap 175 may include a curvature, such that the portion originating from the broken collar commences on one side of the upper front 130 and continues toward the opposite lateral side of the upper front 130. One such preferred opening stops at approximately the wearer's navel to prevent the garment front from being fully opened. This permits easy opening and closing by a wearer who is holding an infant child, while simultaneously preventing the garment from slipping off the shoulders of the wearer. The termination of the opening of the receiving portion 150 and receiving flap 175 defines the area below as the lower front 120.

Figure 2A:
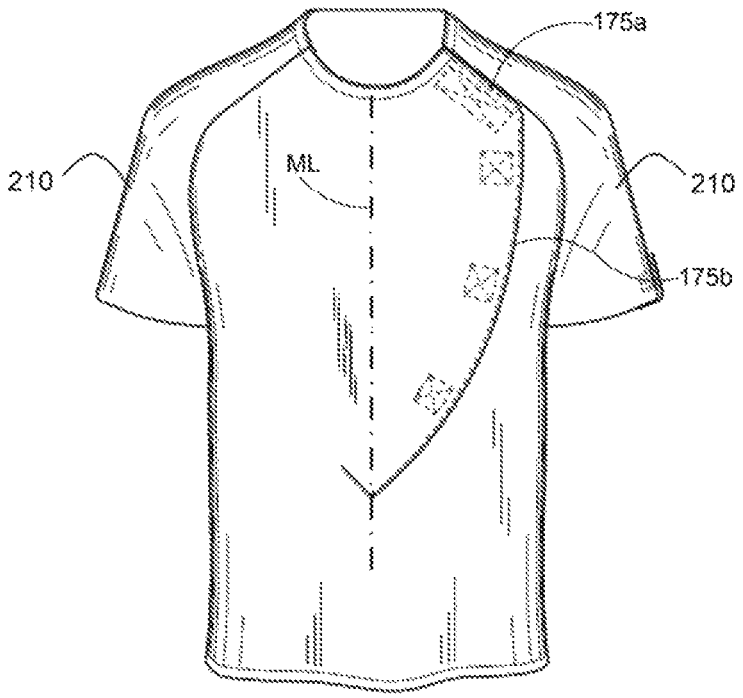
FIGS. 2*a* and 2*b* are front views of an embodiment of the present invention in the form of a raglan sleeve t-shirt.
Figure 2B:
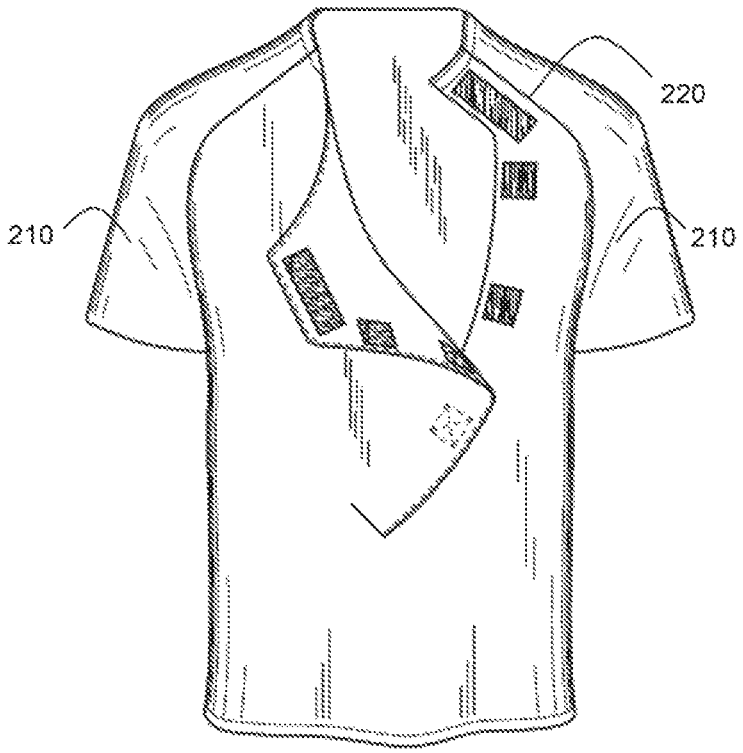

Turning now to FIGS. 2*a* and 2*b*, preferred further exemplary embodiments of the present invention, the bonding garment comprises a shirt having a raglan sleeve structure wherein the raglan sleeves 210 are joined to the front and back of the shirt body at a raglan seam 220. The collar of the shirt, which may be shaped as a crew neck layout or other known layout when closed, is broken to permit opening a receiving portion of the bonding garment, wherein a child will be placed for engaging the child in skin-to-skin contact with the wearer of the garment. In some embodiments, as shown, the seam 220 of one raglan sleeve is extended upward to coincide with one side of the broken collar, preferably the side coincident to the portion of the garment not forming the receiving flap, and may be finished by known methods, such as a foldback or coverstitch. The other side of the receiving portion is comprised of the receiving flap, which when closed mates with the first-described side of the upper front of the garment in order to give the garment the appearance of a typical shirt (or other garment in other embodiments), and to cover an infant who has been placed into the open receiving portion. This construction of the raglan seam 220 coincident to the collar provides excellent maintenance of the stationary portion of the upper front, thereby facilitating particularly well the object of the present invention to provide the maximum possible privacy of a wearer when opening the receiving flap to place a child into or remove a child from kangaroo care through the receiving portion.

Also shown in this embodiment, the uppermost section of the opening of the receiving portion is substantially parallel to the raglan seam 220 and then curves toward the navel of the wearer as the opening approaches the hem. This permits a combination of access to the wearer's body for placement of the bonding child and maintenance of privacy for the wearer. This further facilitates the visual appeal of the garment as a normal article of everyday clothing when closed and not in use for bonding.

It will be noted that other combinations of opening geometry may be employed. For instance, in embodiments not using the raglan sleeve, the opening may retain the angle of the seam described with reference to the raglan sleeve embodiment, therefore causing the two seams to not be parallel, or may alter the angle to again make the portion originating from the collar parallel with the sleeve seam. Other angles and combinations not expressly listed herein are also within the scope of the present disclosure, as would be understood by one of skill in the art.

Figure 3:
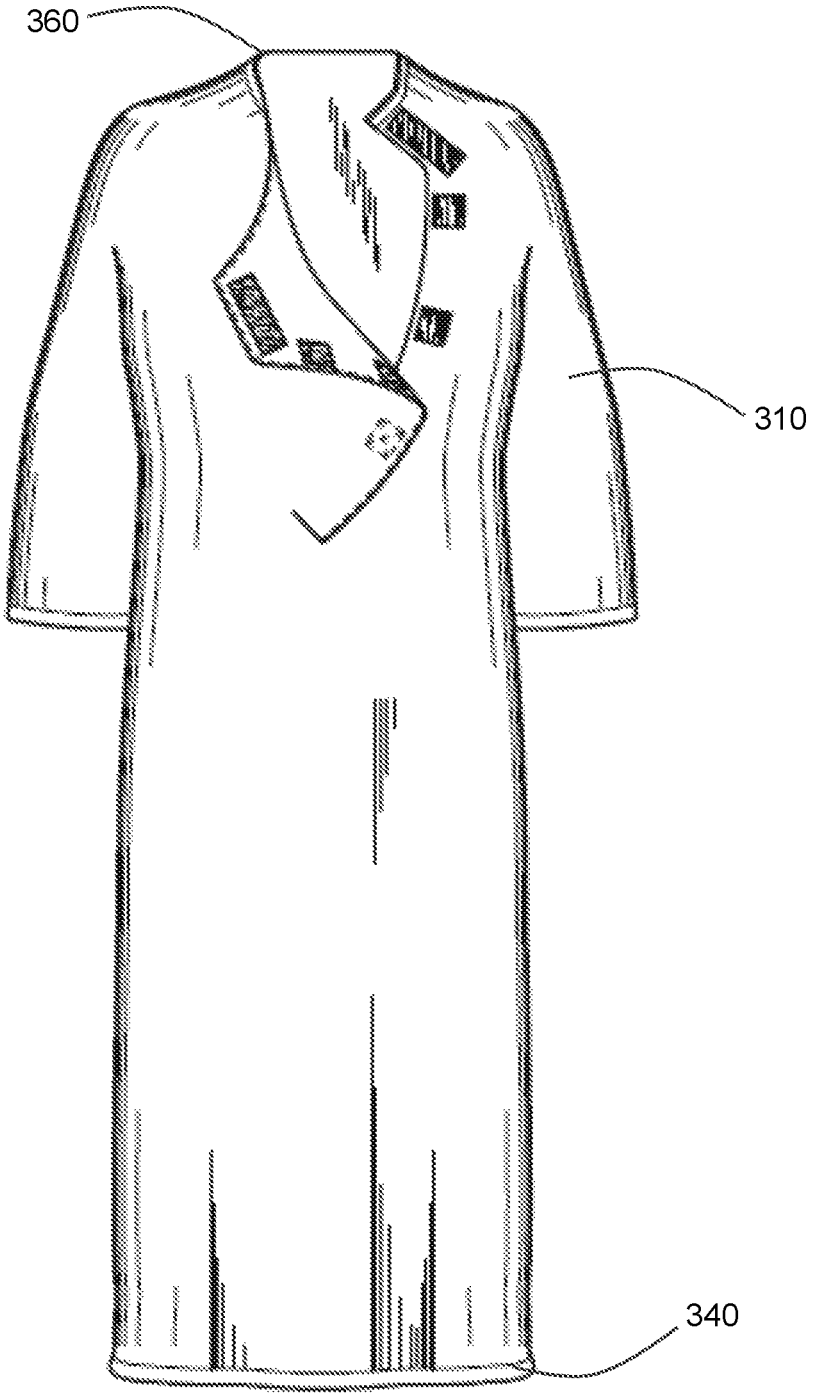
FIG. 3 is a front view of a garment of the present invention in the form of a gown.

Turning now to FIG. 3, an alternate exemplary embodiment is shown in the form of a hospital gown or nightgown. In this embodiment, the garment length from collar 360 to hem 340 is increased to create the typical form of such garment by forming an extended lower front and employing a lower back of corresponding length. As shown in this embodiment, sleeve length may vary and garments may include long sleeves, three quarter sleeves, short sleeves, or may be sleeveless.

While various disclosed embodiments have been described above, it should be understood that they have been presented by way of example only, and not limitation. Numerous changes to the subject matter disclosed herein can be made in accordance with this disclosure without departing from the spirit or scope of this disclosure. In addition, while a particular feature may have been disclosed with respect to only one of several implementations, such feature may be combined with one or more other features of the other implementations as may be desired and advantageous for any given or particular application.

What is claimed is:

1. A garment having a pair of sides and being configured to be worn by an adult having a torso for skin-to-skin bonding with an infant, said garment comprising:

a back panel located between said sides;

a front panel located between said sides and having a longitudinal midline located between said sides, said front panel comprising an upper front portion and a lower front portion, said upper portion including a neck portion and receiving portion located below the neck portion, said receiving portion including a single receiving flap having an upper edge portion and a lower edge portion, said upper edge portion extending downward and outward at an angle from said midline, said lower edge portion merging with said upper edge portion at a merger point and extending downward and inward at an angle from an outer end of said upper edge portion, said lower edge portion terminating closely adjacent to said midline and to said lower front portion, said receiving flap being foldable out of a plane of said front panel about said midline from a closed state to an open state, and vice versa, said receiving flap having outer edge portion located below said merger point, whereupon when said receiving flap is in said closed state said outer edge portion is located closely adjacent a first one of said sides, and when said receiving flap is in said open state said outer edge portion is located further away from said first one of said sides and closer to a second one of said sides; and a plurality of fasteners configured for holding said receiving flap in said closed state.

2. The garment of claim 1, wherein said garment is a t-shirt.

3. The garment of claim 2, wherein said t-shirt comprises a sleeve.

4. The garment of claim 3, wherein said sleeve is a raglan sleeve.

5. The garment of claim 1, wherein said garment is a gown.

6. The garment of claim 5, wherein said gown comprises a sleeve.

7. The garment of claim 1, wherein said receiving flap comprises a placket.

8. The garment of claim 2, wherein said receiving flap comprises a placket.

9. The garment of claim 5, wherein said receiving flap comprises a placket.

10. The garment of claim 1, wherein said plurality of releasable fasteners are selected from the group consisting of buttons, snaps, hook and loop fasteners, and hook and eye closures.

11. The garment of claim 3, wherein said plurality of releasable fasteners are selected from the group consisting of buttons, snaps, hook and loop fasteners, and hook and eye closures.

12. The garment of claim 5, wherein said plurality of releasable fasteners are selected from the group consisting of buttons, snaps, hook and loop fasteners, and hook and eye closures.

* * * * *